US007885583B2

(12) United States Patent
Shigehiro

(10) Patent No.: US 7,885,583 B2
(45) Date of Patent: Feb. 8, 2011

(54) DEVELOPMENT DEVICE AND IMAGE FORMING APPARATUS

(75) Inventor: Koji Shigehiro, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 205 days.

(21) Appl. No.: 12/166,001

(22) Filed: Jul. 1, 2008

(65) Prior Publication Data

US 2009/0016778 A1 Jan. 15, 2009

(30) Foreign Application Priority Data

Jul. 12, 2007 (JP) ..... 2007-182711

(51) Int. Cl.
*G03G 15/09* (2006.01)
*G03G 15/06* (2006.01)
*G03G 15/08* (2006.01)

(52) U.S. Cl. ..... 399/272; 399/222; 399/265; 399/281

(58) Field of Classification Search ..... 399/222, 399/254, 265, 267, 272, 279, 281
See application file for complete search history.

(56) References Cited

U.S. PATENT DOCUMENTS 4,550,068 A * 10/1985 Brooks et al. ..... 399/267 X

FOREIGN PATENT DOCUMENTS

| | | | |
|---|---|---|---|
| JP | 4-358182 | A | 12/1992 |
| JP | 6-202390 | A | 7/1994 |
| JP | 8-314251 | A | 11/1996 |
| JP | 08-314271 | * | 11/1996 |

* cited by examiner

*Primary Examiner*—Sandra L Brase
(74) *Attorney, Agent, or Firm*—Fitzpatrick, Cella, Harper & Scinto

(57) ABSTRACT

An aspect of the invention provides a development device including a rotatable development sleeve which supplies developer to a photosensitive drum, the development sleeve being disposed such that a rotational axis of the development sleeve is orientated toward a vertical direction; a conveying screw which conveys the developer along a rotational axis direction of the development sleeve; and a developer supply guide which guides the developer conveyed by the developer conveying device to the development sleeve. The plural developer supply guides are disposed at predetermined intervals in the rotational axis direction of the development sleeve and between the development sleeve and the conveying screw.

8 Claims, 10 Drawing Sheets

DEVELOPMENT DEVICE AND IMAGE FORMING APPARATUS

BACKGROUND OF THE INVENTION

1. Field of the Invention

The present invention relates to a development device which develops an electrostatic image formed on an image bearing member using a developer and an image forming apparatus, such as a copying machine, a printer, and a facsimile, which is provided with the development device.

2. Description of the Related Art

Generally, a recording material is conveyed in a horizontal state in many components of an image forming apparatus which forms an image on the recording material such as plain paper and OHP film, using a developer. Therefore, the image forming apparatus has a disadvantage that the apparatus has a large installation area.

On the other hand, for example, Japanese Patent Application Laid-Open No. 6-202390 discloses an image forming apparatus, in which the apparatus is formed in a stand-up state in order to decrease the apparatus installation area and the recording material is conveyed while substantially being substantially upright.

Japanese Patent Application Laid-Open No. 8-314251 discloses a detailed configuration of a development device in the "stand-up type" image forming apparatus. As shown in FIG. 10, a case 100 is partitioned into a developer refilling chamber 102 and a development chamber 103 by a partition wall 101, a new developer is stored in the developer refilling chamber 102, and a development roller 104 is disposed in the vertical direction in the development chamber 103.

A cylindrical developer conveying path 105 is provided between the developer refilling chamber 102 and the development chamber 103, and a conveying screw 106 is rotatably disposed in the developer conveying path 105. Developer discharge ports 102*a* and 103*a* are formed in a bottom portion of the developer conveying path 105. Therefore, the developer from the development chamber 103 and the developer from the developer refilling chamber 102 flow into a bottom portion of the conveying screw 106. Accordingly, when the conveying screw 106 is rotated, the developer located in the bottom portion of the conveying screw 106 is conveyed to the upper portion and supplied from a supply port 107 into the development chamber 103.

Japanese Patent Application Laid-Open No. 4-358182 discloses a configuration in which a rotational axis of a development sleeve is provided so as to be orientated toward the vertical direction. A belt is disposed in order to supply a magnetic developer from a lower portion to an upper portion along a surface of the development sleeve. A plurality of blades are provided at equal intervals on a surface of the belt, and the magnetic developer is conveyed by the blades.

The stand-up type image forming apparatus has an advantage in that the installation space can be decreased.

However, the above-described conventional configurations have the following problems. That is, in the configuration in which the toner is supplied to the development sleeve while the developer located in the bottom portion is conveyed to the upper portion by the toner conveying unit, the supplied toner amount is decreased as the toner conveys up, which causes a problem in an uneven coating is generated in the vertical direction of the development sleeve.

Fluidity of the developer is easily changed by a change in humidity or temperature in an environment in which the toner is used, and sometimes an amount of developer supplied to the developer bearing member becomes unstable. In the case where the developer is conveyed in the gravity direction, a difference in the amount of supplied developer is easily generated in the vertical direction of the developer bearing member. That is, sometimes uniform image formation is hardly performed depending on the environment in the conventional method in which the developer is conveyed to the upper portion by the developer conveying member and the developer flowing down near the developer bearing member.

SUMMARY OF THE INVENTION

In accordance with an aspect of the invention, a development device includes a rotatable developer bearing member which develops a latent image formed on an image bearing member, the developer bearing member being disposed such that a rotational axis of the developer bearing member is orientated in up-and-down direction; a developer conveying device which conveys a developer along a rotational axis direction of the developer bearing member; and a plurality of developer supply guides which are disposed along the rotational axis direction, the developer supply guides guiding the developer while tentatively reserving the developer, the developer being conveyed by the developer conveying device.

In accordance with another aspect of the invention, an image forming apparatus includes the development device which develops the latent image formed on the image bearing member.

Further features of the present invention will become apparent from the following description of exemplary embodiments (with reference to the attached drawings).

DESCRIPTION OF THE EMBODIMENTS

An image forming apparatus provided with a development device according to an exemplary embodiment of the invention will be described below with reference to the drawings.

First Embodiment (Entire Configuration of Image Forming Apparatus)

Figure 1:
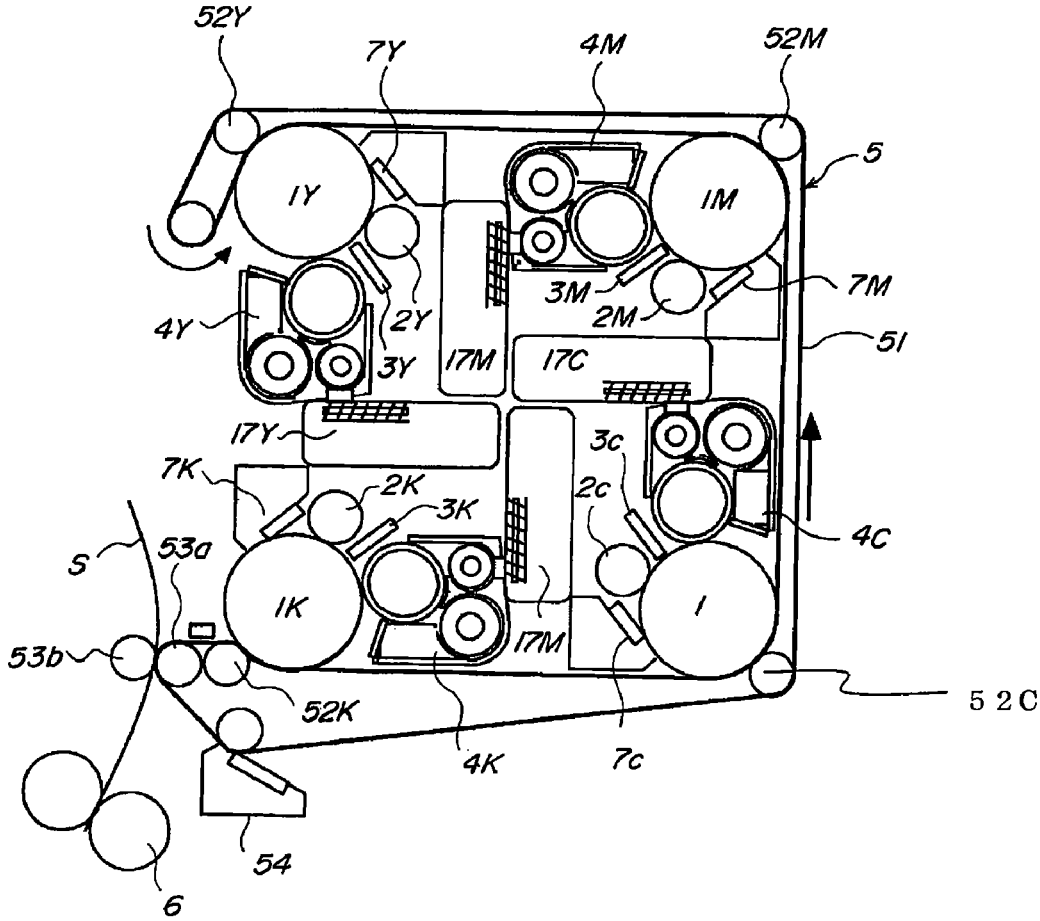
FIG. 1 is a horizontal sectional view illustrating a schematic configuration of an image forming apparatus provided with a stand-up type development device according to a first embodiment of the invention when viewed from above.

An entire configuration and an operation of an image forming apparatus according to a first embodiment of the invention will be described with reference to FIG. 1. FIG. 1 is a horizontal sectional view illustrating a schematic configuration of an image forming apparatus provided with a stand-up type development device of the first embodiment when viewed from above.

As used herein, the stand-up type image forming apparatus shall mean an image forming apparatus which can be operated while rotational axis directions (lengthwise directions) of cylindrical members such as a photosensitive member, a developer bearing member, and various conveying rollers are disposed in a substantially vertical direction. An image forming apparatus 100 of the first embodiment is an electrophotographic image forming apparatus including four image forming stations which form yellow (Y), magenta (M), cyan (C), and black (K) images respectively.

The first to fourth image forming portions are image forming portions which sequentially form yellow, magenta, cyan, and black images, and the first to fourth image forming portions have the same configuration except for the developer color. The letters Y, M, C, and K illustrated in FIG. 1 designate components corresponding to the yellow, magenta, cyan, and black image forming portions, respectively. However, in the following description, the letters Y, M, C, and K are neglected as long as a need for distinguishing the colors from one another does not particularly occur.

Each image forming station includes a drum-shaped electrophotographic photosensitive member (hereinafter referred to as "photosensitive drum") 1. The photosensitive drum 1 is an image bearing member which is disposed such that a rotational axis direction of the image bearing member is orientated toward a vertical direction. A charging roller 2 which is a component of a charging unit, an exposure device 3, a development device 4, a transfer device 5, and a cleaning device 7 are provided around the photosensitive drum 1. The transfer device 5 includes an intermediate transfer belt 51 which is a component of an intermediate transfer member. The intermediate transfer belt 51 is i.e., travels, in the direction shown by an arrow direction in FIG. 1 while entrained about plurality of rollers. A primary transfer roller 52 is disposed at a position located across the intermediate transfer belt 51 from each photosensitive drum 1. Secondary transfer rollers 53*a* and 53*b* are provided at a position facing one of the rollers about which the intermediate transfer belt 51 is entrained.

In forming an image, a surface of the rotating photosensitive drum 1 is evenly charged by a charging roller 2. The charging roller 2 is driven by the photosensitive drum 1. Then, the surface of the charged photosensitive drum 1 is exposed according to an image information signal with the exposure device 3, thereby forming an electrostatic latent image on the photosensitive drum 1. The development device 4 visualizes the electrostatic latent image formed on the photosensitive drum 1 in the form of a toner image using developer toner. The toner image formed on the photosensitive drum 1 is transferred (primary-transferred) onto the intermediate transfer belt 51 by action of a primary transfer bias applied to the primary transfer roller 52 at a primary transfer portion in which the intermediate transfer belt 51 and the photosensitive drum 1 abut on each other. For example, in forming a four-color (full-color) image, the toner image is transferred onto the intermediate transfer belt 51 from each photosensitive drum 1 on the order from the first image forming portion Y, and a multiple-toner image in which four-color toner images are superimposed is formed on the intermediate transfer belt 51.

On the other hand, in synchronization with the image formation, recording material conveying members (not illustrated) such as a pick-up roller, a conveying roller, and a registration roller convey a recording material S stored in a recording material storage portion to a secondary transfer portion in which the intermediate transfer belt 51 and the secondary transfer roller 53 abut on each other. The multiple-toner image on the intermediate transfer belt 51 is transferred onto the recording material S by action of a secondary transfer bias applied to the secondary transfer roller 53 in the secondary transfer portion.

Then, the recording material S separated from the intermediate transfer belt 51 is conveyed to a fixing device 6, the fixing device 6 heats and pressurizes the recording material S to melt and mix the toner images, thereby fixing the toner images onto the recording material S. Then, the recording material S is discharged to the outside of the apparatus.

An adhesive substance, such as the toner remaining on the photosensitive drum 1 after the primary transfer process, is recovered by a cleaning device 7. Therefore, the photosensitive drum 1 prepares for the next image forming process. The adhesive substance, such as the toner remaining on the intermediate transfer belt 51 after the secondary transfer process, is removed by an intermediate transfer member cleaner 54.

In the image forming apparatus of the first embodiment, a monochrome image, such as a black image or a multi-color image, can also be formed using a desired one of or a plurality of color image forming portions.

(Development Device)

Figure 2:
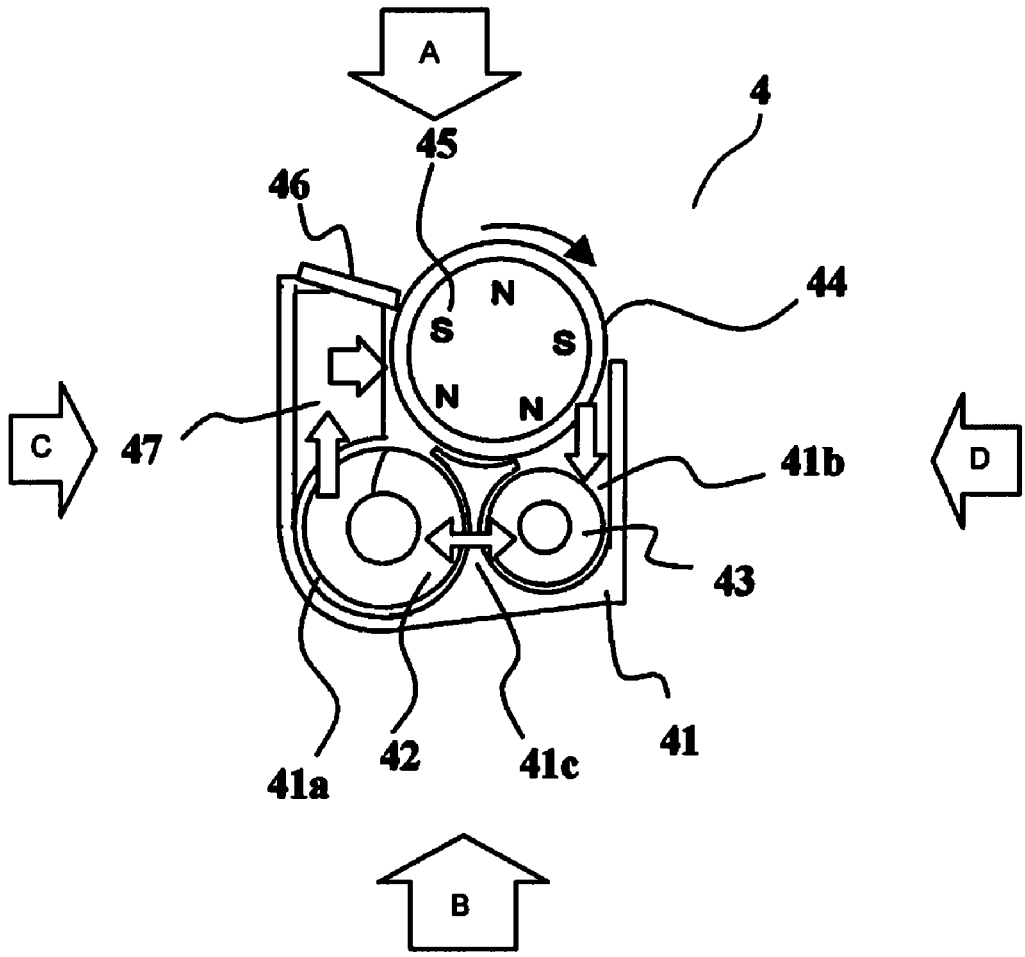
FIG. 2 is an explanatory view illustrating the development device of the first embodiment when viewed from above.

The development device 4 of the first embodiment will be described below with reference to FIGS. 2 to 6. FIG. 2 is an explanatory view illustrating the development device of the first embodiment when viewed from above. FIGS. 3 to 6 are sectional views schematically illustrating the development device when viewed from directions shown by arrows A (FIG. 3), B (FIG. 4), C (FIG. 5), and D (FIG. 6) of FIG. 2.

As shown in FIG. 2, the stand-up type development device 4 of the first embodiment includes a development container 41 in which a two-component developer containing the toner and carrier is stored. A development sleeve 44 which is of a developer bearing member is rotatably provided in the development container 41. The development sleeve 44 can be rotated to supply the developer to the photosensitive drum 1, and the development sleeve 44 is disposed such that the rotational axis direction of the development sleeve 44 is orientated toward the vertical direction. A five pole magnet roller 45 which is a component of a fixedly-disposed magnetic field generating unit is provided in the development sleeve 44. A regulating blade 46 abuts on the surface of the development sleeve 44. The regulating blade 46 is a developer amount regulating member which forms a thin layer of the developer on the surface of the development sleeve 44.

A first and second developer conveying members 42 and 43 are also disposed in the development device 4. The first and second developer conveying members 42 and 43 stir the developer in the development container 41 which is a component of a casing, and the first and second developer conveying members 42 and 43 convey the developer. The first and second developer conveying member 42 and 43 are formed by conveying screws each having a spiral vane member. The conveying screws are disposed such that rotational axes of the conveying screws are orientated toward the vertical direction. The first conveying screw 42 is disposed in a development chamber 41*a*, and the first conveying screw 42 conveys the developer to the upper portion in the vertical direction in order to supply the developer to the development sleeve 44. The second conveying screw 43 is disposed in a recovery chamber 41*b* to convey the developer to the lower portion in the vertical direction. The recovery chamber 41*b* recovers the developer used in the development process by the development sleeve 44 and conveys the developer to the development chamber 41*a*.

Figure 4:
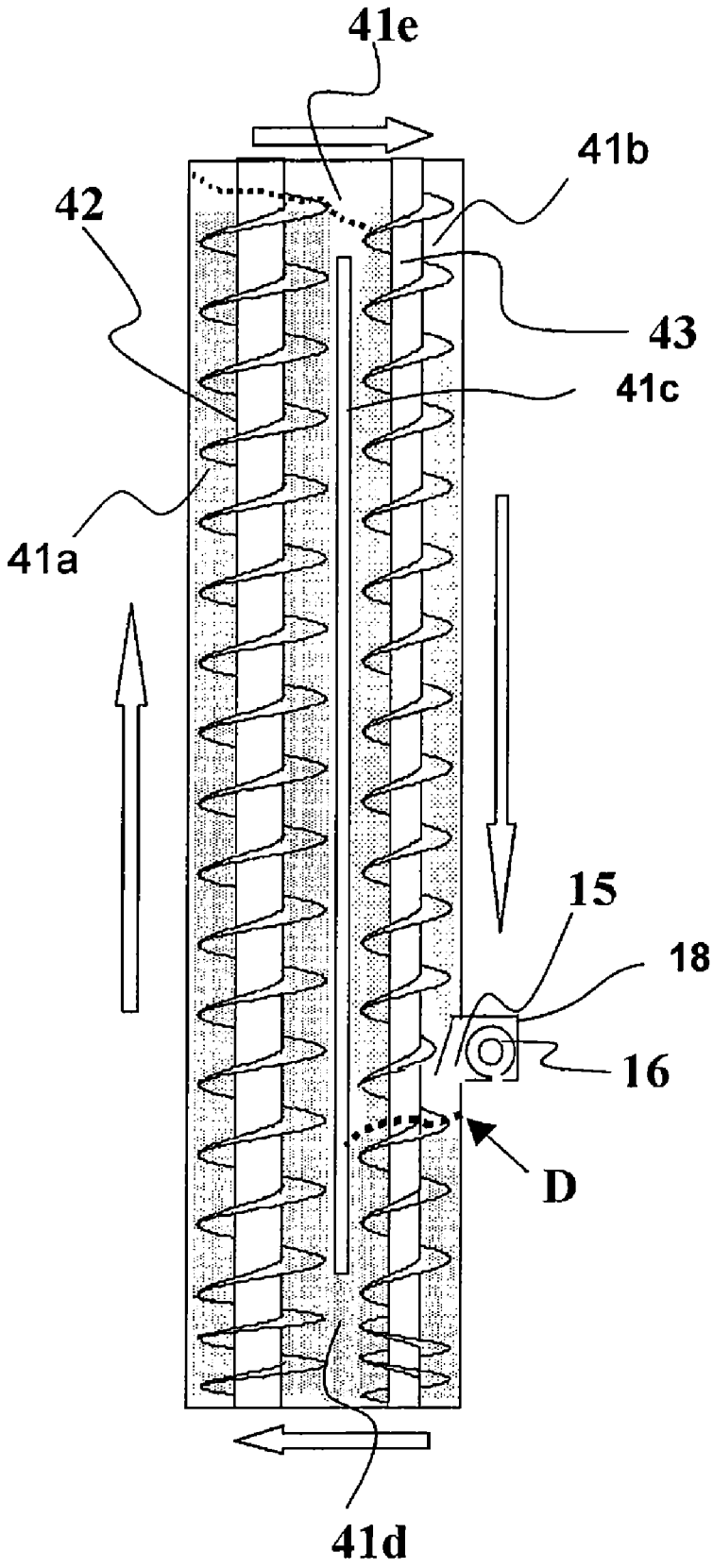
FIG. 4 is a sectional view schematically illustrating the development device when viewed from the direction shown an arrow B of FIG. 2.

The development chamber 41*a* and the recovery chamber 41*b* are separated from each other by a partition wall 41*c*, and the development chamber 41*a* and the recovery chamber 41*b* are in communication with each other at both a lower-end delivery portion 41*d* and an upper-end delivery portion 41*e* (see FIG. 4). The developer in the recovery chamber 41*b* can be delivered to the development chamber 41*a* by the delivery portions 41*d* and 41*e* (the developer conveying direction in the development device 4 is indicated by the arrows in FIG. 2).

Figure 3:
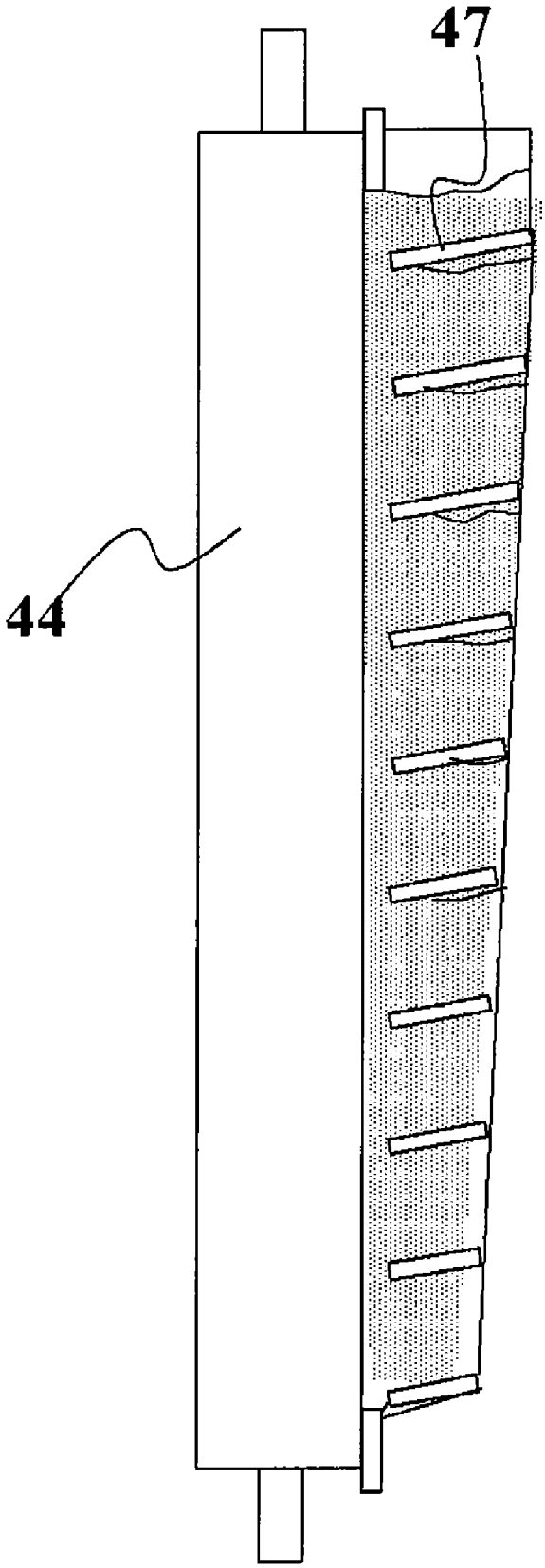
FIG. 3 is a sectional view schematically illustrating the development device when viewed from the direction shown by an arrow A of FIG. 2.

A developer supply guide (also referred to as a "developer supplying guide") 47 is provided between the development sleeve 44 and the conveying screw 42. The developer supply guide 47 is used as a guide when the developer conveyed by the first conveying screw 42 is supplied to the development sleeve 44. As shown in FIG. 3, the developer supply guide 47 is formed by a plurality of plate members which are disposed so as to be able to tentatively retain the developer, and the plate members are disposed at predetermined intervals in the rotational axis direction of the development sleeve 44. In the developer supply guide 47, an end portion on the side of the development sleeve 44 (developer bearing member side) is inclined toward the lower portion in the vertical direction compared with an end portion on the side of the first conveying screw 42 (developer conveying unit side). That is, the developer supply guide 47 is provided while being inclined with a predetermined angle with respect to the horizontal direction. Therefore, the developer conveyed by the first conveying screw 42 is supplied to the developer supply guide 47, and the developer is supplied to the development sleeve 44 so as to slip off along the developer supply guide 47.

Figure 5:
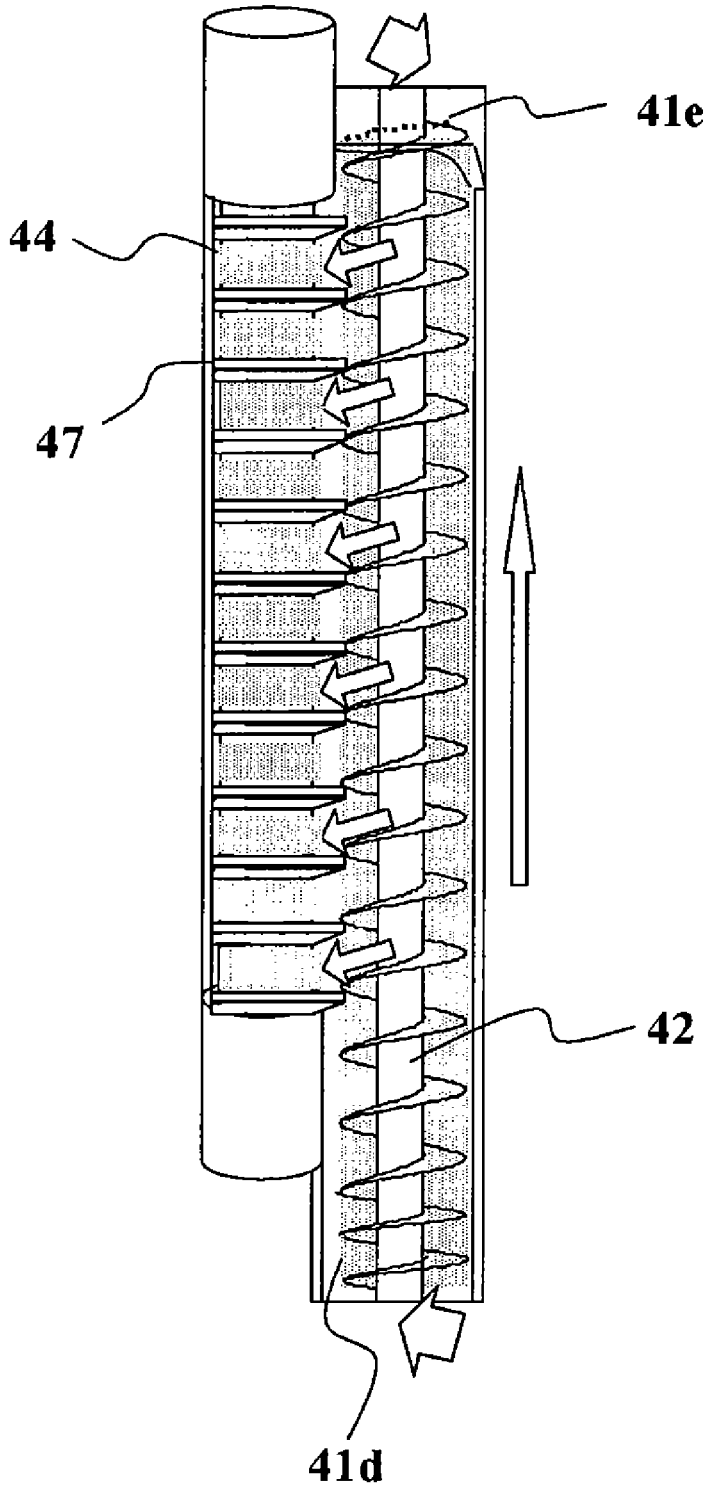
FIG. 5 is a sectional view schematically illustrating the development device when viewed from the direction shown by an arrow C of FIG. 2.

An operation for supplying the developer to the development sleeve 44 will be described below. As illustrated in FIGS. 3 to 5, in an initial state of the developer during the image forming operation, substantially whole regions of the developer supply guide 47 and development chamber 41*a* and a lower portion of the recovery chamber 41*b* are filled with the developer in the development device 4.

As shown in FIG. 5, the two-component developer in the development device 4 is delivered to the upper portion by the first conveying screw 42 of the development chamber 41*a* while being supplied to the developer supply guide 47. As shown in FIG. 3, the developer is supplied to the development sleeve 44 after tentatively being retained on the developer supply guide 47. The developer is repulsed by the development sleeve 44 from the developer supply guide 47 by the magnet roller 45 included in the development sleeve 44, and a predetermined amount of developer is conveyed to a development region by the regulating blade 46. The developer is supplied to the developer supply guide 47 due to a conveying force in a circumferential direction generated by the vane of the first conveying screw 42 and a magnetic force influence by the magnet roller 45.

The developer is conveyed to the development region of the development sleeve 44 and the developer on the developer supply guide 47 is consumed. As the developer amount on the developer supply guide 47 is decreased, the new developer is replenished from the conveying screw 42 of the development chamber 41*a*.

It is assumed that gaps between the plate members of the developer supply guide 47 are filled with the developer up to an upper stage in the initial state before the developer is used for the first image formation. In the plate members of the developer supply guide 47 of the first embodiment, an area of an upper surface becomes broader toward the upward direction, and an upper guide portion reserves a larger amount of developer compared with a lower guide portion.

Because the developer amount retained by the lower guide portion of the developer supply guide 47 is smaller than that of the upper guide portion of the developer supply guide 47, the lower guide portion of the developer supply guide 47 is filled with the developer for a relatively short time. When the developer supply guide 47 is filled with the developer, because the conveying screw 41*a* does not convey the developer in the circumferential direction, efficiency for upwardly conveying the developer is improved in the conveying screw 41*a*, and the developer is also sequentially supplied to the upper guide portion of the developer supply guide 47.

Figure 6:
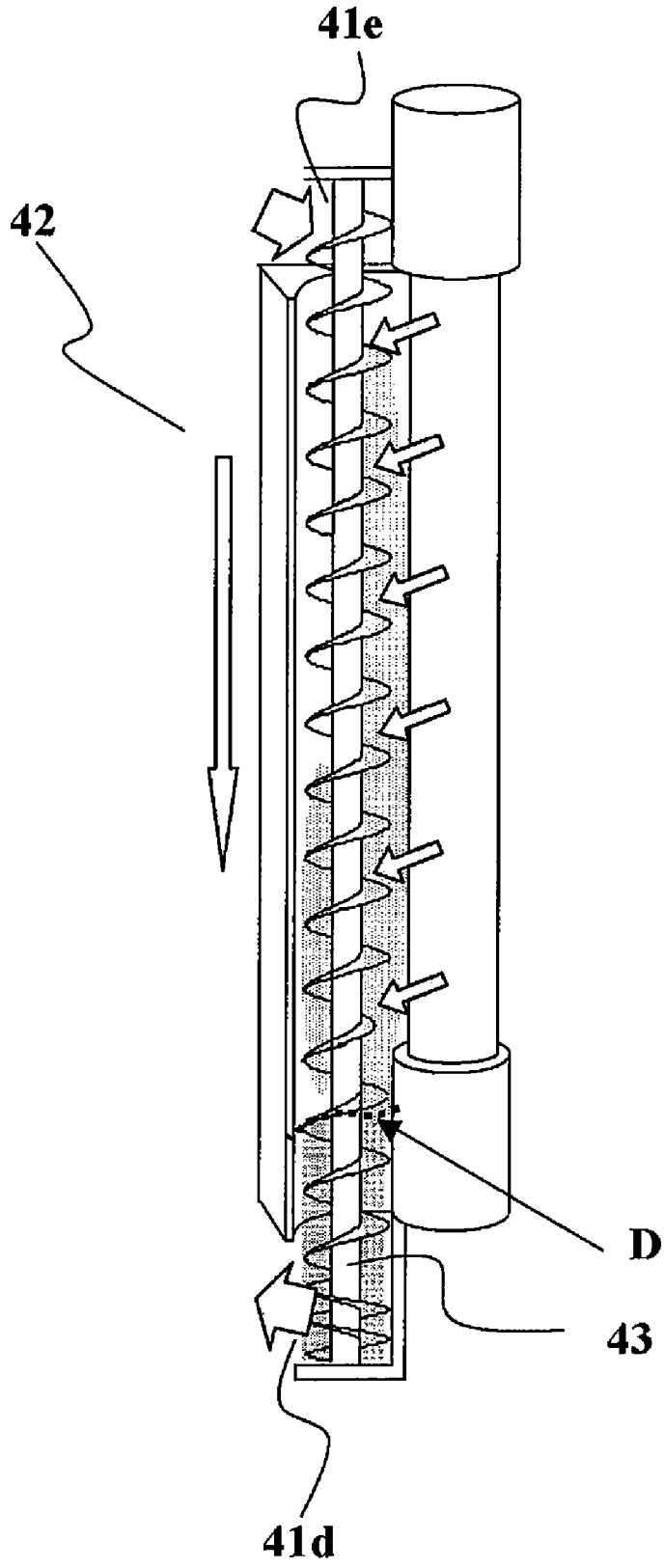
FIG. 6 is a sectional view schematically illustrating the development device when viewed from the direction shown by an arrow D of FIG. 2.

On the other hand, after the developer is used in the development process, the developer on the development sleeve 44 is coerced off from the development sleeve 44 by a repulsive magnetic field generated by a magnetic pole of the magnet roller 45 located between the development chamber 41*a* and the recovery chamber 41*b*, and the recovery chamber 41*b* recovers the developer. In the development chamber 41*a*, as shown in FIG. 6, the developer which is conveyed to the upper end of the development chamber 41*a* while not supplied to the developer supply guide 47 by the first conveying screw 42 is delivered to the recovery chamber 41*b* at the upper end of the development chamber 41*a*, and the developer is conveyed to the lower portion by the second conveying screw 43.

Because a developer circulating amount and a developer circulating speed are substantially kept constant in the development device 4, as shown in FIG. 4, a developer surface D can be formed at a given height above a region (delivery portion) 41*d* where the developer is delivered from the recovery chamber 41*b* to the development chamber 41*a*.

The development device 4 of the first embodiment includes a refilling port 15 for a refilling developer above the developer surface. The developer refilling amount is determined by utilizing a video count method and a toner patch method. In the video count method, consumption of the refilling developer is computed from image data read from an original reading device or image data fed from a host device. In the toner patch method, a reference image (patch image) is formed by developing a reference latent image formed on the photosensitive drum 1, the patch image is transferred onto the intermediate transfer belt 51, and reflection density of the patch image is detected by an optical sensor. Then, toner density (a weight ratio of the developer and toner) of the developer is detected, and the supply toner amount is controlled based on the detection result. The toner density is detected by the toner patch method, and the refilling developer amount computed by the video count method is corrected.

In the second conveying screw 43 of the recovery chamber 41*b*, a stirring vane has a small diameter in a part adjacent to the refilling port 15. A hood-shape invasion prevention member 18 is provided in the refilling port 15 so as to prevent invasion of the developer from upper and side surfaces. The refilling developer is conveyed from a refilling developer storage container 17 (see FIG. 1) by a refilling screw 16, and the refilling screw 16 refills the developer refilling amount determined by the refilling method while the developer refilling amount is divided. The refilled developer falls on the developer surface D of the recovery chamber 41*b*, and the refilled developer is conveyed while being mixed with the developer which is conveyed from above and used in the development process and the developer overflowing from the development chamber 41*a*.

(Experimental Result)

In order to confirm the effect of the developer supply, a development experiment was performed using the development device of the first embodiment in which the developer supply guide 47 was provided and a development device in which the developer supply guide 47 was not provided. The experiment was performed by evaluating a developer bearing amount M/S (weight per unit area) in the lengthwise direction in the development region of the development sleeve 44 and image density unevenness on paper in forming the image.

In the development device of the first embodiment, as shown in FIG. 3, the guide plates constituting the developer supply guide 47 are inclined with an angle of 10° so as to be lowered toward the development sleeve 44. The ten guide plates were disposed at an interval of 25 mm in a range of about 300 mm which was of an image forming region of the development sleeve 44.

The area of the upper surface of each guide plate of the developer supply guide 47 was gradually increased by 5% in the order from the lower-most guide plate. In this case, the top-most guide plate had a size of 12 mm×15 mm, the size of the guide plates was gradually decreased from the second guide plate, and the lower-most guide plate had a size of 7 mm×15 mm.

The end portion facing the conveying screw 42 of the developer supply guide 47 are formed into an arc shape along the edge of the screw. A difference in powder pressure depending on a depth can be decreased in the vertical direction by disposing the guide plates of the developer supply guides 47 at equal intervals in the vertical direction. The guide plates of developer supply guide 47 act as a buffer which tentatively reserves the toner. Therefore, even if the conveyance of the toner to the upper portion of the development sleeve becomes difficult due to an environmental change, a temporal change, or an image forming condition, the toner can stably supplied to the development sleeve.

A two-component developer having T/D=8% (toner weight/developer weight), which was formed by polymer toner having a particle size of about 7 μm and magnetic material dispersion carrier having a particle size of 35 mm, was used as the developer.

A member which could cover the development sleeve surface along a curvature except for predetermined areas was used in the measurement of M/S on the development sleeve 44, and the developers in the predetermined areas were sampled from the upper end, center, and lower end of the development sleeve 44 using a magnet.

The print image density was measured using a spectrocolorimetry densitometer X-Rite 530JP. The pieces of image density corresponding to the developer bearing amount measurement positions on the development sleeve 44 were measured and compared.

In the development device 4 of the first embodiment, M/S of about 30 mg/cm$^2$ was evenly obtained in the lengthwise direction on the development sleeve 44 at the initial stage, and there was little difference. A horizontal band image having enough width to measure the density was printed on an A4 sheet, and the image density was measured in the part corresponding to the M/S measurement point on the development sleeve 44. A substantially uniform image density of 1.47 was obtained.

Therefore, the area on the upper surface side of an upper portion of the developer supply guide 47 in the vertical direction is set broader than that of a lower portion, whereby the developer is sufficiently supplied to the development sleeve 44 in the upper portion in the gravity direction where the developer is hardly conveyed. Therefore, in the stand-up type development device, the difference in powder pressure depending on the depth can be decreased in the vertical direction to supply the developer to the whole of the development sleeve 44.

The developer is deteriorated to lower the fluidity due to stirring of the screw, the passage of the regulating blade, and the shear between the developers as the number of image forming operations is increased. In the developer whose fluidity is lowered, a conveyance property is decreased, the amount of developer supplied to the upper portion of the development sleeve 44 is decreased, and M/S is possibly lowered.

Therefore, in an N/N (normal temperature/normal humidity: about 23° C./43%) environment, the image forming operation was performed for 3000 A4 sheets with 1% duty. 100% duty corresponds to a solid image, and a 1% duty is a severe low-duty test for the deterioration of the fluidity of the developer. The M/S on the development sleeve 44 and the image density of the horizontal band image were measured at that time.

In a typical image forming apparatus such as the copying machine, 3000 continuous images are rarely formed with the duty as low as of 1%, and it is said that the 1% duty is the severe condition for the deterioration of the developer.

However, in the development device of the first embodiment, the M/S on the development sleeve and the image density of the horizontal band image were substantially uniform in the lengthwise direction.

Comparative Example

Figure 7:
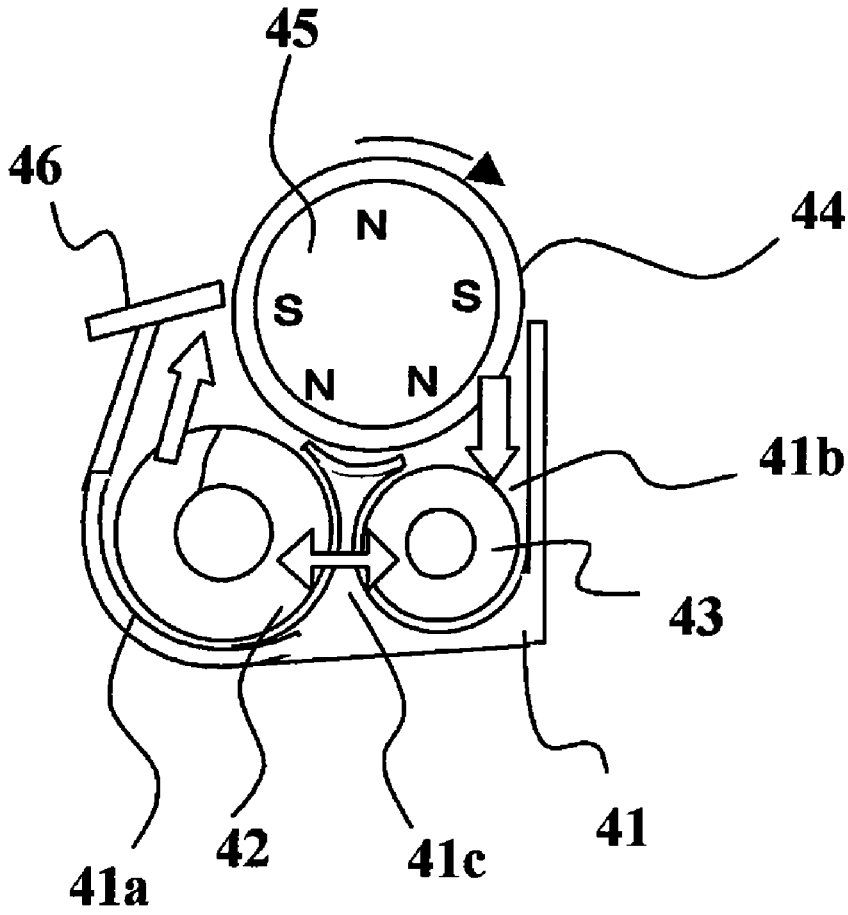
FIG. 7 is an explanatory view illustrating a configuration of a development device in which a developer supply guide is not used.

FIG. 7 is an explanatory view illustrating a configuration of a development device in which the developer supply guide 47 is not used. In the configuration of FIG. 7, means for conveying the developer from the first conveying screw 42 to the development region is realized by a coercive force of the magnet roller 45 included in the development sleeve 44 and a conveying force in the circumferential direction of the first conveying screw 42. In the configuration of FIG. 7, similarly to the experiment of the development device of the first embodiment, M/S on the development sleeve 44 and the image density of the horizontal band image were compared at the initial stage and after 3000 images were formed.

For the M/S on the development sleeve 44, at the initial stage, a lower end had an M/S of 31 mg/cm$^2$, the center had an M/S of 30.5 mg/cm$^2$, and the upper end had an M/S of 29.5 mg/cm$^2$. The upper end was slightly smaller than the lower end and the center. After 3000 images were formed, the lower end had an M/S of 36.2 mg/cm$^2$, the center had M/S of 28.0 mg/cm$^2$, and the upper end had an M/S of 26.3 mg/cm$^2$. The M/S was increased at the lower end while the M/S was decreased at the upper end. For the image density, at the initial stage, a substantially uniform density was obtained in the lengthwise direction of the development sleeve 44. However, after 3000 images were formed, the image density was increased to 1.54 at a position corresponding to the lower end of the development sleeve 44, and the image density was decreased to 1.35 at a position corresponding to the upper end.

Thus, when the development device of the first embodiment is applied to the stand-up type image forming apparatus, the M/S unevenness in the lengthwise direction on the development sleeve 44 can be prevented to provide a high-quality image.

Second Embodiment

A development device according to a second embodiment of the invention will be described below with reference to FIG. 8. Because a basic configuration of the development device of the second embodiment is similar to that of the first embodiment, a description thereof is not necessary, and only a characteristic configuration of the second embodiment will be described. The components having the same function as the first embodiment are designated by the same reference numerals and characters.

Figure 8:
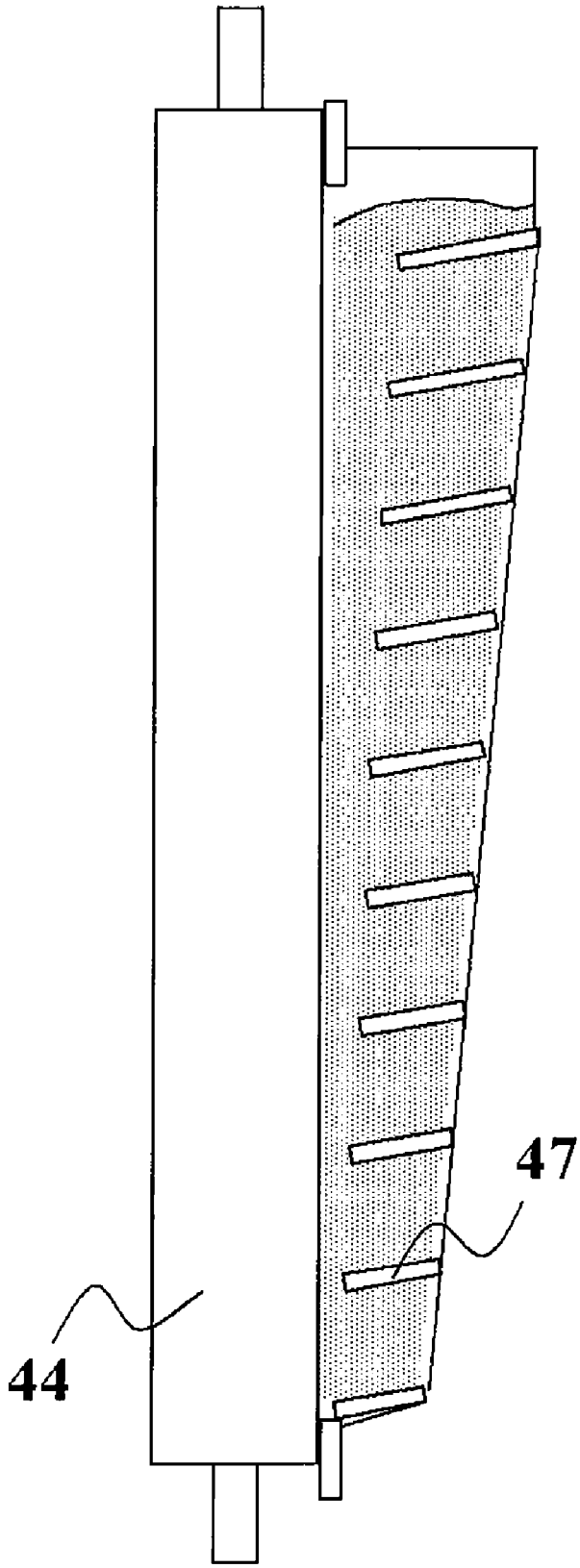
FIG. 8 is a sectional view illustrating a development device according to a second embodiment of the invention.

FIG. 8 is a sectional view illustrating the development device of the second embodiment, and FIG. 8 corresponds to FIG. 3 of the first embodiment.

The second embodiment differs from the first embodiment in that a distance between an end portion on the development sleeve 44 of the developer supply guide 47 and the development sleeve 44 of an upper portion of the developer supply guide 47 in the vertical direction is broader than that of a lower portion of the developer supply guide 47.

The developer is retained between the guide and the development sleeve by the magnetic force in the development sleeve. Therefore, in the configuration of the second embodiment, the amount of developer supplied to the development sleeve 44 can be increased even if the area of the developer supply guide 47 is not enlarged.

An image forming experiment was formed under the same conditions as the first embodiment using the development device of the second embodiment. In the development device of the second embodiment, a uniform image having no M/S unevenness could be obtained even if the images were formed for 4000 sheets in which the fluidity of the developer was further deteriorated compared with the first embodiment.

Third Embodiment

A development device according to a third embodiment of the invention will be described below with reference to FIG. 9. Because a basic configuration of the development device of the second embodiment is similar to that of the first and second embodiments, a repetitive description is not necessary, and only a characteristic configuration of the third embodiment will be described. The components having the same function as the first and second embodiments are designated by the same reference numerals and characters.

Figure 9:
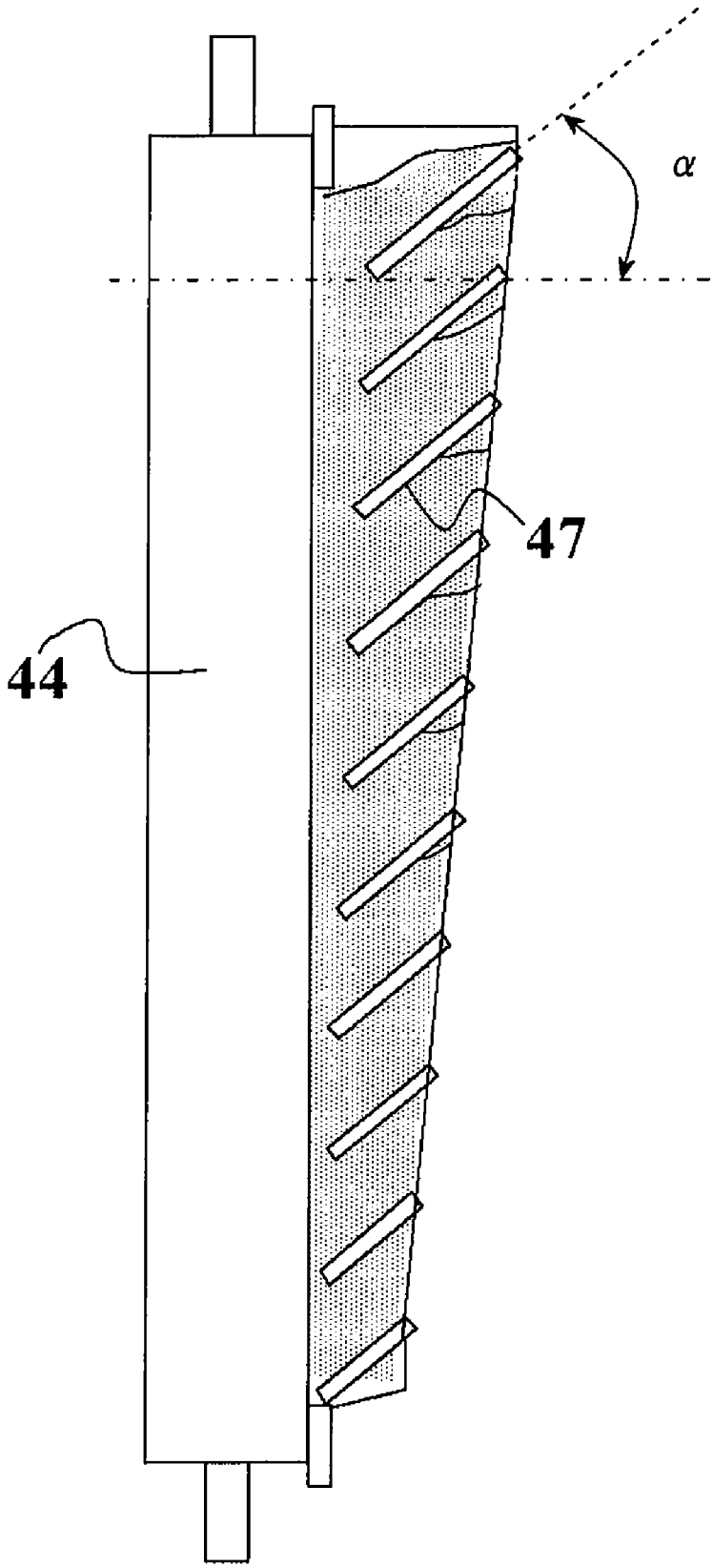
FIG. 9 is a sectional view illustrating a development device according to a third embodiment of the invention.
Figure 10:
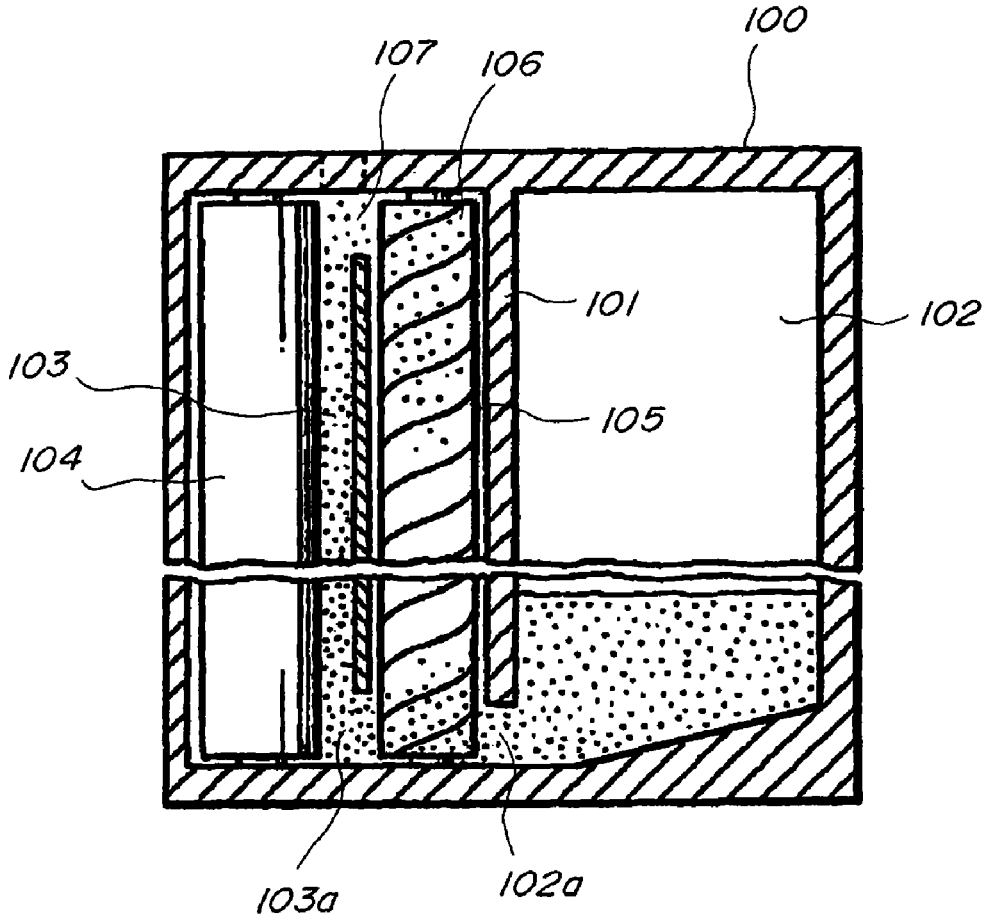
FIG. 10 PRIOR ART
FIG. 10 is an explanatory view of a conventional device.

FIG. 9 is a sectional view illustrating the development device of the third embodiment, and FIG. 9 corresponds to FIG. 3 of the first embodiment.

The third embodiment differs from the second embodiment in that an inclination angle ($\alpha$) of the developer supply guide 47 is not lower than an angle of repose of the developer with respect to the horizontal surface.

As used herein, an angle of repose shall mean an angle which is formed by a horizontal surface and an edge line of a powder mountain formed when powder falls on the horizontal surface through a funnel, and the angle of repose indicates the fluidity of the powder. When the powder falls on an inclined surface through the funnel, the powder has a characteristic in which all the powder does not remain on the inclined surface but falls in the case where the angle formed between the inclined surface and the horizontal surface is not lower than the angle of repose.

Thus, when the angle formed between the inclined surface and the horizontal surface of the developer supply guide 47 is set to be no lower than the angle of repose of the developer, the residence of the developer can effectively be prevented on the developer supply guide 47, and the developer is efficiently supplied to the upper portion of the development sleeve 44 in the gravity direction.

In the measurement, the developer used in the third embodiment had an angle of repose of 35°. Therefore, the angle ($\alpha$) formed by the horizontal surface and the developer supply guide 47 of the third embodiment was set to 40°.

In a low humidity environment in which the fluidity was lowered due to an influence of an electrostatic force, using the development device of the third embodiment, the image formation was performed with an image duty of 1% like the first and second embodiments.

The images were formed up to 5000 sheets in which the fluidity of the developer was further deteriorated compared with the second embodiment. However, the M/S unevenness was not generated in the lengthwise direction of the development sleeve 44, and the M/S unevenness corresponding to the developer supply guide 47 was not generated. Therefore, a high-quality image can be provided.

Fourth Embodiment

A development device according to a fourth embodiment of the invention will be described below. Because a basic configuration of the development device of the fourth embodiment is similar to that of the first to third embodiments, a repetitive description is not necessary, and only a characteristic configuration of the fourth embodiment will be described. The components having the same functions as those in the first to the third embodiments is designated by the same reference numerals and characters.

The fourth embodiment differs from the third embodiment in that an upper portion of the development sleeve 44 in the vertical direction is narrower than that of a lower portion of the development sleeve 44 in the vertical direction in a pitch between the portions of the stirring vane of the first conveying screw 42. The first conveying screw 42 having a spiral vane member is disposed in the development chamber 41*a* such that the rotational axis of the first conveying screw 42 is orientated toward the vertical direction.

In the conventional stand-up type image forming apparatus and development device, when the fluidity of the developer is lowered, the conveying speed of the conveying screw is lowered, and the amount of developer supplied to the upper portion of the development sleeve 44 is insufficiently obtained, which results in a problem in that the M/S unevenness is generated on the development sleeve 44.

Therefore, in the fourth embodiment, in a range from the top to the center in the lengthwise direction of the development sleeve 44, a pitch between sections of the stirring vane of the first conveying screw 42 is set by a factor of 1.2 of the stirring vane of the first embodiment. In a range from the bottom to the center in the lengthwise direction of the development sleeve 44, the pitch between sections of the stirring vane is set by a factor of 0.8 of the pitch of the sections of the stirring vane of the first embodiment.

Therefore, advantageously the conveying speed is improved in the lower portion of the first conveying screw 42, and the conveying amount is improved in the upper portion.

In a low humidity environment in which the fluidity was lowered due to an influence of an electrostatic force, using the development device of the fourth embodiment, image formation was performed with an image duty of 1% like the first and second embodiments. In the configuration of the fourth embodiment, the images were formed on up to 6000 sheets in which the fluidity of the developer was further deteriorated compared with the third embodiment. However, the M/S unevenness was not generated in the lengthwise direction of the development sleeve 44, but the developer was uniformly coated.

The pitch between the sections of the stirring vane of the conveying screw 42 is set gradually narrower toward the upper portion in the vertical direction, so that the conveying amount can sufficiently be ensured in the upper portion of the developer conveying member.

On the other hand, for the purpose of comparison, a similar image forming experiment was performed using the usual conveying screw, i.e., the pitch between the sections of the stirring vane is equal. When the images were formed up to 6000 sheets, M/S at the upper end of the development sleeve 44 was decreased to 25 mg/cm$^2$, while the development sleeve 44 had M/S of 30 mg/cm$^2$ at the upper end in the initial stage. At that time, the difference in image density of the horizontal band image was 1.46 at the initial stage, and the difference was slightly decreased to 1.42 after the images were formed up to 6000 sheets.

Thus, when the development device of the fourth embodiment is applied to the stand-up type image forming apparatus whose installation area is decreased, the M/S unevenness can be prevented in the lengthwise direction of the developer bearing member to provide a high-quality image.

Other Embodiments

In the above-described embodiments, the color image forming apparatus includes the four image forming stations. The development device of the embodiments can similarly be applied to the monochrome image forming apparatus including only one image forming station.

The detailed configurations such as the shape of the developer supply guide 47 and the absence or presence of the conveying screw 43 provided in the recovery chamber 41*b* are not limited to the above-described embodiments.

In the stand-up type image forming apparatus of the invention in which the installation area is decreased, the amount of toner supplied to the upper portion in the vertical direction of the developer bearing member can sufficiently maintained, and the powder pressure applied to the developer can be dispersed. Therefore, the generation of the unevenness of the developer amount in the vertical direction which is of the gravity direction can be prevented on the surface of the developer bearing member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-182711, filed Jul. 12, 2007, which is hereby incorporated by reference herein in its entirety.

What is claimed is:

1. A development device comprising:

a rotatable developer bearing member which develops a latent image formed on an image bearing member, the developer bearing member being disposed such that a rotational axis of the developer bearing member is orientated in an up-and-down direction;

a developer conveying device which conveys a developer along a rotational axis direction of the developer bearing member; and a plurality of developer supplying guides which are disposed to face to the rotatable developer bearing member to be fixed along the rotational axis direction, wherein the plurality of developer supplying guides guide the developer to the developer bearing member while tentatively reserving the developer conveyed by the developer conveying device.

2. The development device according to claim 1, wherein the plurality of developer supplying guides are configured such that an area on an upper surface side of a first developer supplying guide is broader than an upper surface of a second developer supplying guide located lower than the first developer supplying guide.

3. The development device according to claim 1, wherein the plurality of developer supplying guides are configured such that a distance between an end portion on a developer bearing member side and a developer bearing member of a first developer supplying guide is broader than that of a second developer supplying guide located lower than the first developer supplying guide.

4. The development device according to claim 1, wherein the plurality of developer supplying guides are obliquely provided such that an angle formed by a horizontal surface and the plurality of developer supplying guides are not lower than an angle of repose of the developer.

5. The development device according to claim 1, wherein the developer conveying unit includes a conveying screw having a spiral vane member, the conveying screw being disposed such that a rotational axis of the conveying screw is orientated in the up-and-down direction.

6. The development device according to claim 5, wherein a pitch between a first portion of the vane member is narrower than a second portion of the vane member located lower than the first portion.

7. An image forming apparatus in which a latent image formed on an image bearing member is developed and the developed image is transferred to a recording material to form an image, the image forming apparatus comprising a development device which develops the latent image formed on the image bearing member, wherein the development device includes:

a rotatable developer bearing member which develops the latent image formed on the image bearing member, the developer bearing member being disposed such that a rotational axis of the developer bearing member is orientated in an up-and-down direction;

a developer conveying device which conveys a developer along a rotational axis direction of the developer bearing member; and a plurality of developer supplying guides which are disposed to face to the rotatable developer bearing member to be fixed along the rotational axis direction, wherein the plurality of developer supplying guides guide the developer to the developer bearing member while tentatively reserving the developer conveyed by the developer conveying device.

8. A development device comprising:

a rotatable developer bearing member which develops a latent image formed on an image bearing member, the developer bearing member being disposed such that a rotational axis of the developer bearing member is orientated in an up-and-down direction;

a developer conveying device which conveys a developer along a rotational axis direction of the developer bearing member; and a developer supplying guide which is disposed to be fixed along the rotational axis direction at a position facing to the rotatable developer bearing member, wherein the developer supplying guide guides the developer to the developer bearing member while tentatively reserving the developer conveyed by the developer conveying device.

* * * * *